United States Patent [19]

Eshelman

[11] 4,223,249

[45] Sep. 16, 1980

[54] PULSE GENERATING MEANS

[75] Inventor: Philip V. Eshelman, Southfield, Mich.

[73] Assignee: Colt Industries Operating Corp., New York, N.Y.

[21] Appl. No.: 851,488

[22] Filed: Dec. 21, 1977

[51] Int. Cl.[2] ..... H05B 37/02; H05B 39/04; H05B 41/36

[52] U.S. Cl. ..... 315/209 M; 315/209 R; 315/209 T; 123/617

[58] Field of Search ..... 315/209 R, 209 T, 209 SC, 315/209 M; 123/148 E, 148F, 148 CA, 148 DK

[56] References Cited

U.S. PATENT DOCUMENTS

| | | | |
|---|---|---|---|
| 3,316,448 | 4/1967 | Hardin et al. | 315/209 R |
| 3,356,896 | 12/1967 | Shano | 315/209 R |
| 3,395,685 | 8/1968 | Minks | 315/209 R |
| 3,715,650 | 2/1973 | Draxler | 315/209 SC |
| 3,723,809 | 3/1973 | Fujii | 315/209 SC |
| 3,757,754 | 9/1973 | Wiegand | 123/148 E |
| 3,948,239 | 4/1976 | Katsumata | 315/209 R |

*Primary Examiner*—Saxfield Chatmon, Jr.
*Attorney, Agent, or Firm*—Walter Potoroka, Sr.

[57] ABSTRACT

A bistable magnetic wire has an electrically conductive wire coiled thereabout as to form, generally, a magnetic wire assembly which is situated in spaced proximity to a magnet; the opposite ends of the conductive wire are electrically connected to related output or receiving apparatus; a shield or shutter arrangement operated generally between the magnetic wire assembly and the magnet serves to cause the magnetic wire to be at times placed under the influence of the magnetic field of the magnet thereby resulting in the magnetic wire changing from one stable state to another state and in so doing inducing a voltage into the conductive wire to produce a pulse across the said opposite ends thereof.

26 Claims, 17 Drawing Figures

PULSE GENERATING MEANS

BACKGROUND OF THE INVENTION

Heretofore the prior art has suggested the use of a bistable ferromagnetic wire of generally uniform composition having a central relatively "soft" core portion and an outer relatively "hard" magnetized shell portion with relatively low and high coercivity, respectively, whereby the magnetized shell portion is operable for magnetizing the core portion in a first direction with such magnetization of the core portion being reversible by application of a separate magnetic field and the shell portion being further operable to remagnetize the core portion in the said first direction upon removal of the said separate magnetic field. This type of magnetic wire is herein referred to as a bistable magnetic wire or bistable magnetic means, or the like, and at least one embodiment thereof is disclosed and described in U.S. Pat. No. 3,820,090 dated June 25, 1974, the teachings of which are herein incorporated by reference. Further, a least one method for manufacturing such a bistable magnetic wire or device is disclosed and described in U.S. Pat. No. 3,892,118 dated July 1, 1975, the teachings of which are also herein incorporated by reference.

The prior art has also, heretofore, suggested that such a bistable magnetic device, in association with a separate magnetic field and an inductive coil, could be employed for producing electrical pulses. One such arrangement for producing electrical pulses is disclosed and described in U.S. Pat. No. 3,757,754 dated Sept. 11, 1973, wherein, as at FIGS. 2 and 3 thereof, it is proposed that a rotatable member 20 be provided with a plurality of bistable magnetic wires 10 arranged in angularly spaced relationship thereabout so that as the rotatable member is rotated the bistable magnetic wires sequentially pass next to a stationary sensing head comprised of a permanent magnet and an inductive field-like coil wound about the magnet. Various problems have been found to exist with respect to such an arrangement as: by way of example and not limitation, the inability to obtain a sufficiently strong inductive voltage into the coil as to be able to reliably subsequently employ the resulting pulse signal for any control function; and the practical difficulty if not impossibility of sufficiently accurately locating and positioning the plurality of bistable magnetic wires on the rotatable member as to be assured of the necessary resulting accuracy of angular spacing as between successive bistable magnetic wires as well as the required consistency of dimensional spacing between the respective bistable magnetic wires and the separate magnet and coil assembly as such bistable magnetic wires travel past the separate magnet and coil assembly.

In U.S. Pat. No. 3,780,313 dated Dec. 18, 1973, the prior art again discloses and describes a pulse generating apparatus employing a plurality of rotatable bistable magnetic wires as already hereinbefore described.

Accordingly, the invention as herein disclosed and described is primarily directed to the solution of the prior art and other attendant and related problems. Even though the invention is illustrated as embodied within structure comprising an engine ignition distributor assembly, the invention is, of course, not so limited as will become apparent.

SUMMARY OF THE INVENTION

According to the invention, a pulse generator comprises bistable magnetic means, electrically conductive inductive wire means coiled about said bistable magnetic means and having at least first and second ends, magnet means, said bistable magnetic means and coiled wire means being situated in close proximity to and spaced from said magnet means, and shielding means interposed generally between said magnet means and said magnetic means and coiled wire means, said shielding means being effective to at times place said magnetic means under the influence of the magnetic field of said magnet means in order to thereby cause said magnetic means to change magnetic states and induce a voltage into said coiled wire to produce an electrical pulse across said first and second ends.

Various general and specific objects, aspects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
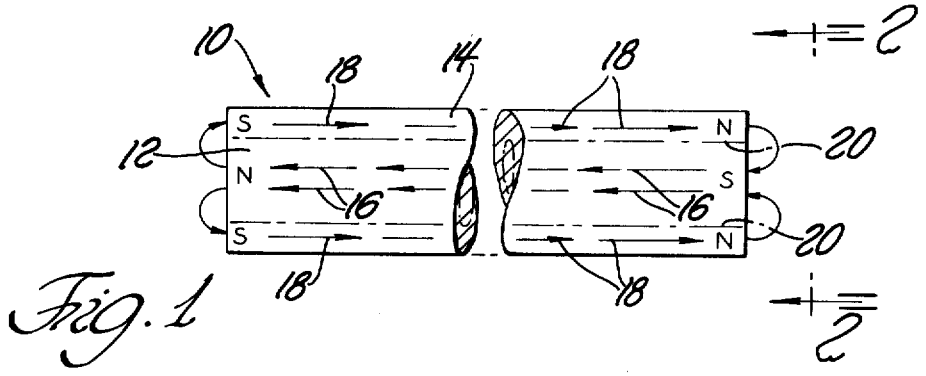
FIG. 1 illustrates in enlarged generally diagrammatic representations a side or longitudinal elevational view, partly broken away, one embodiment of a bistable magnetic wire, employable in the teachings of the invention, depicted in one of its magnetic states.

Referring now in greater detail to the drawings, FIG. 1 depicts a wire 10 of suitable ferromagnetic material having a generally uniform composition and, for example, formed by a drawing process. As known in the art, such wire may be treated to form a magnetic central portion (which may be referred to as a core) and a magnetic outer portion (which may be referred to as a shell) having different net magnetic characteristics and which cooperate to form an effective self-nucleating magnetic wire. Although such a wire may be formed of any suitable material and any related suitable dimension, by way of example, the wire 10 may be in the order of five-eighths inch long, have a diameter in the order of 0.012 inch and be made of a commercially available wire alloy having, for example, forty-eight percent iron and fifty-two percent nickel. The wire is processed to form a relatively "soft" magnetic wire core 12 having relatively low magnetic coercivity and a relatively "hard" magnetic wire shell 14 having relatively high magnetic coercivity thereby making such shell effective to magnetically bias the magnetic core 12. The term "coercivity" is employed to indicate the magnitude of the external magnetic field necessary to bring the net magnetization of a magnetized sample of such material to zero.

Figure 2:
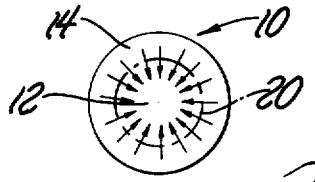
FIG. 2, also generally diagrammatic, is a view taken generally on the plane of line 2—2 of FIG. 1 and looking in the directions of the trace of said plane.

Generally, the relatively "soft" core 12 and the relatively "hard" shell 14 are magnetized, with the respective axes of magnetization being substantially parallel to the axis of the overall wire 10. Further, as depicted, shell 14 is magnetized to form north (N) and south (S) poles at its opposite ends. The shell 14 has a coercivity sufficiently greater than that of the relatively soft core 12 resulting in core 12 becoming coupled to the shell 14 by causing the net magnetization of the core 12 to align in an axial direction opposite to the axial direction of the net magnetization of the shell 14 as indicated in FIG. 1. (The direction of magnetic lines in the core 12 are depicted by arrows 16 while the direction of magnetic lines in the shell are depicted by arrows 18.) When the core 12 is thusly coupled to the shell 14, the core 12 forms a magnetic return path or shunt for the shell 14 as generally depicted by the flux lines 16 in FIG. 1 and a domain wall interface 20 is formed in the wire 10 between the oppositely directed lines of flux therein. The domain wall interface 20 defines, generally, the boundary between the core 12 and shell 14. Generally, such domain boundary wall 20 may be thought of as having a cylindrical configuration as depicted in FIGS. 1 and 2 although, in reality, such depicted interface may actually be a rather irregular and indefinite transition zone in the wire 10. For purposes of understanding the invention, it is not necessary that either the location or configuration of such interface be precisely determined in that it is sufficient to establish, as is already known in the art, that a core 12 and shell 14 of differing magnetic characteristics do exist in a bistable magnetic device under consideration.

Generally, as depicted in FIGS. 1 and 2, the bistable magnetic wire or device 10 is illustrated in one of its states, that being the one attained in the absence of an external magnetic field permitting the higher coercivity shell 14 to capture the core 12 so that the net magnetization of the core will be opposite in direction to that of the shell 14. As depicted, in this state the core 12 provides an effective return path for most all, if not all, of the magnetic flux of the shell 14 and therefore, there is a very slight, if any at all, external magnetic field about the magnetic wire or device 10. For practical purposes, and for purposes of discussion, when the device 10 is in its state depicted in FIG. 1, it will be considered to have no external magnetic field.

Figure 3:
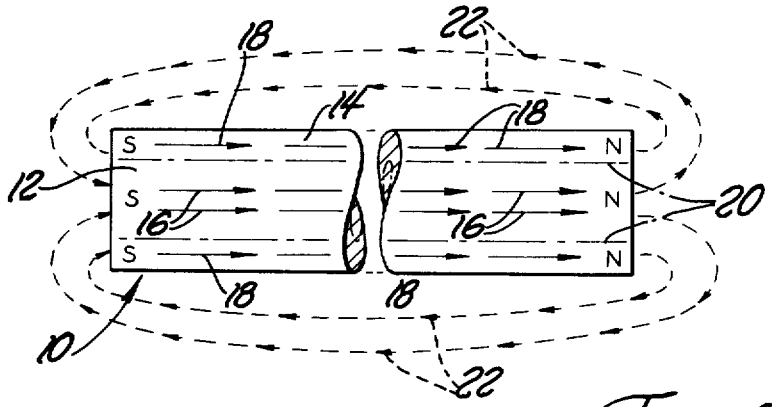
FIG. 3 is a view similar to that of FIG. 1 and depicting the bistable magnetic wire in a second of its magnetic states.

As already generally indicated, an external magnetic field can be employed to overcome the effect of the shell 14 and to cause the magnetization of the core 12 to switch or reverse. For example, if a sufficiently strong bar magnet is brought sufficiently close to the magnetic wire 10, in a parallel orientation to the wire 10 and with its magnetic field polarity in opposition to the polarity of the wire shell 14, such bar magnet will capture the core 12 to reverse the direction of the net magnetization in the core 12. The switching will occur when the field strength, of such an assumed bar magnet, at the core 12 exceeds in absolute magnitude the field strength at the core 12 from the shell 14. When this occurs, the direction of the flux path, as depicted by arrows 16, reverses from the direction shown in FIG. 1 to the direction illustrated in FIG. 2. Consequently, instead of a shunted or internal return flux path as in FIG. 1, the magnetic wire 10 has an external magnetic flux path or field as generally depicted at 22 in FIG. 3. Accordingly, as should be apparent, if a coil is placed in proximity to the bistable magnetic device 10 and such magnetic device 10 is made to switch from its first stable state as depicted in FIG. 1 to and from its second state as depicted in FIG. 3, the build-up and collapse of the magnetic field 22 will result in the generation of an electrical pulse electrically across such coil.

Figure 4:
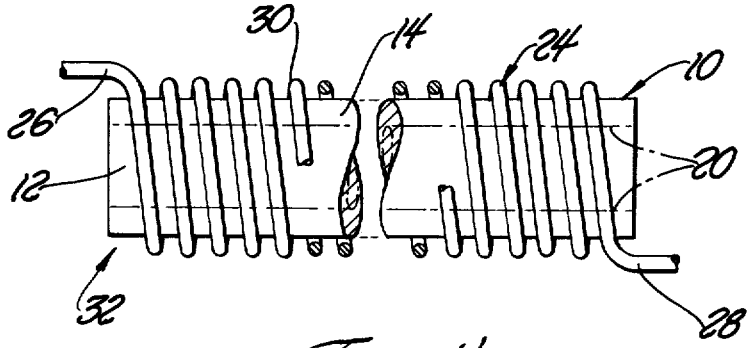
FIG. 4 is a view illustrating the device of FIGS. 1–3 provided with an inductive coil means wound thereabout.

According to the invention, it is proposed that the bistable magnetic means 10 be provided with electrically conductive means 24 coiled thereabout, generally illustrated in FIG. 4, as to have opposite ends 26 and 28 effective for electrical connection to related electrical signal receiving means. In the preferred embodiment, the means 24 comprises an insulated electrically conductive wire 30 coiled about the body of magnetic device 10 as to have the axis of such coiling generally parallel to the axes of the flux path as depicted by lines 16 and 18 of FIG. 1. For ease of reference, the general arrangement as depicted in FIG. 4 (the bistable magnetic means 10 and coil means 24) will, at least at times, be referred to as a "magnetic coil assembly" or "magnetic coil assembly means" 32. In any event, it should be apparent that as the magnetic means 10 is switched from its state depicted in FIG. 1 to its state depicted in FIG. 3, the flux path changes from one being internally shunted to that as depicted in FIG. 3 thereby resulting in the coils of coil means 24 being intersected by the radially outwardly expanding magnetic field 22 causing a voltage pulse, as sensed electrically across ends 26, 28, to be induced into coil means 24. Similarly, when the magnetic means 10 is subsequently switched from its state in FIG. 3 to its state in FIG. 1, the expanded magnetic field 22 collapses and returns to its internal shunt flux path thereby resulting in the coils of coil means 24 again being intersected by the radially inwardly collapsing magnetic field 22 which, again, causes a voltage pulse to be induced into coil means 24.

Accordingly, it can be seen that the magnetic coil assembly means 32 provides an electrical signal or pulse generating means when switched from one state to another state. The manner and means of achieving such switching will be described with reference to structure, employable in practicing the teachings of the invention, yet to be disclosed and described.

Figure 5:
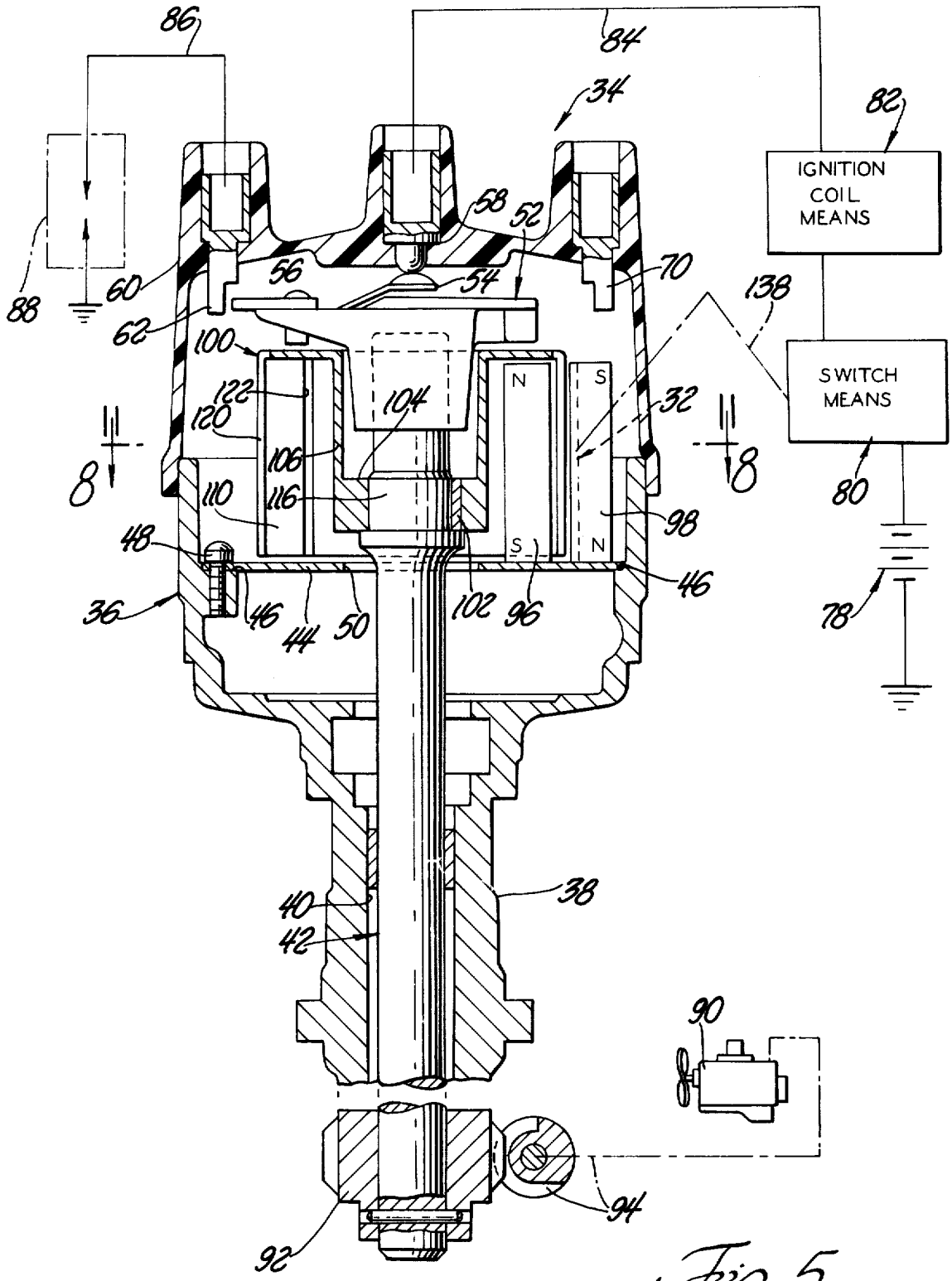
FIG. 5 is a generally axial cross-sectional view of an engine ignition distributor assembly employing teachings of the invention.

FIG. 5 illustrates, in somewhat simplified form, an engine ignition distributor embodying teachings of the invention. Referring in greater detail to FIG. 5, the ignition distributor 34 is illustrated as comprising a housing 36 including a depending reduced portion 38 having an opening 40 therethrough for the reception of a drive shaft 42. The upper end of the cup-shaped housing 36 carries a generally transversely extending plate 44, which may be of generally annular configuration, suitably mounted as on internally formed abutment or shoulder-like support portions 46 and suitably secured thereto as by screw means as typically illustrated at 48. Plate 44 is provided with an aperture 50 for accommodating the passage therethrough of shaft means 42.

An insulated distributor rotor 52, having a spring-like electrical contact 54 thereon and connected to a discharge terminal 56 carried as an arm of the rotor 52, is operatively secured to the upper portion of shaft means 42 and is adapted to be rotated thereby normally in accordance with engine speed. Discharge terminal 56, electrically connected to an ignition input terminal 58 of the distributor cap 60 as through the contact 54 being continually biased thereagainst, is adapted to sequentially traverse the output terminals 62, 64, 66, 68, 70, 72, 74 and 76 (also see FIG. 9) of cap 60 and is so positioned that the terminal 56 and corresponding output terminal are in general juxtaposition whenever the electrical discharge therebetween occurs.

Generally schematically and diagrammatically, FIG. 5 also illustrates a related suitable source of electrical potential 78 electrically connected in series with related switching means 80 and ignition coil means 82. Suitable electrical conductor means 84 interconnects coil means 82 to the coil input terminal 58 while typically illustrated, an electrical conductor 86 electrically interconnects output terminal 62 to a corresponding engine spark plug or igniter means 88.

Distributor drive shaft 42 is, of course, rotated in timed relation to the operation of an associated engine 90 as by means of a gear member 92 cooperating with related suitable output transmission means 94 associated with engine 90.

Figure 8:
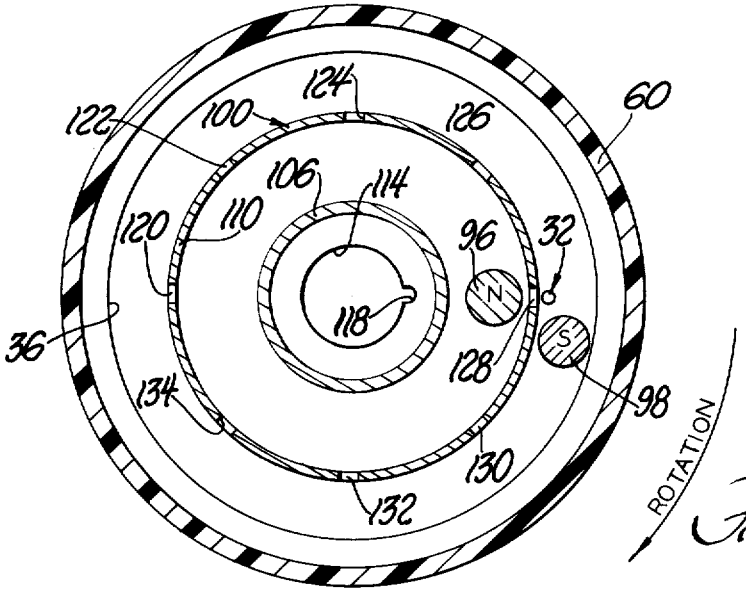
FIG. 8 is a cross-sectional view taken generally on the plane of line 8—8 of FIG. 5 and looking in the direction of the arrows with certain of the elements shown in FIG. 5 being omitted for purposes of clarity.

FIGS. 5 and 8 also illustrate first and second magnet members 96 and 98 along with magnetic coil assembly means 32 suitably fixedly secured to the mounting or support plate 44, in generally spaced relationship, as to be each extending upwardly therefrom. A cup-like shutter or shielding means 100 is shown secured, as by a press-fit, to distributor shaft means 42 and preferably keyed thereto as by suitable keying means 102.

Figure 6:
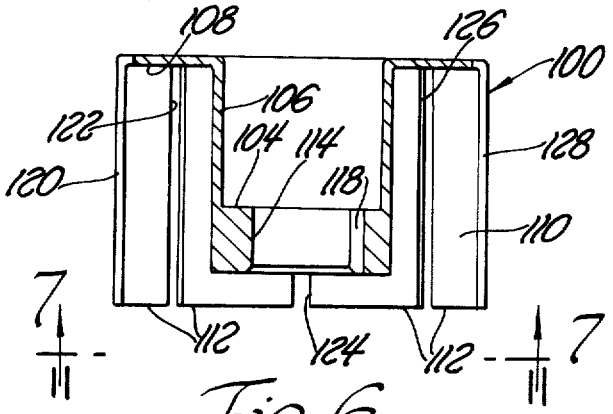
FIG. 6 is a generally axial cross-sectional view of one of the elements shown in FIG. 5.
Figure 7:
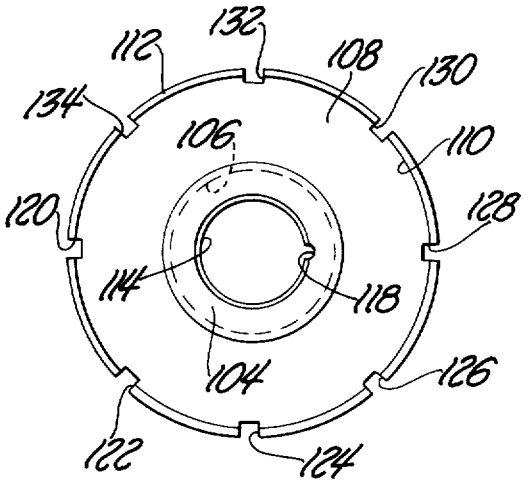
FIG. 7 is a view taken generally on the plane of line 7—7 of FIG. 6 and looking in the direction of the arrows.

Referring to FIGS. 5, 6 and 7, the shutter means 100 is illustrated as being formed of a ferrous material, such as, for example, steel and of a cup-like configuration having a central body portion 104 with an integrally formed upwardly extending tubular or inner cylindrical wall portion 106 which, at its upper end, joins with an integrally formed generally radially directed annular flange-like portion 108 which, in turn, at its radially outer-most periphery integrally joins with a downwardly depending cylindrical outer wall 110 terminating as at a lower edge 112. Body 104 has an aperture 114 formed therethrough the surface of which co-acts with mounting surface 116 of distributor shaft means 42. Further, a slot 118 is also formed generally axially in the surface of aperture 114 as to receive therein keying means 102 (also operatively carried by shaft means 42) for maintaining a desired angular relationship of shutter means 100 with respect to shaft means 42 and thereby maintain the timing relationship as may be desired with respect to operation of engine 90. In the embodiment of the invention disclosed, and not by way of limitation, eight axially parallel extending slots are formed in outer wall 110 as depicted at 120, 122, 124, 126, 128, 130, 132 and 134. Generally, as shaft means 42 is rotated (in the direction as depicted by arrow 136 of FIG. 8) such slots are successively brought into alignment as between magnet 96 and magnetic coil assembly means 32 causing the means 32 to change states thereby producing a pulse signal (across its coil ends 26, 28 FIG. 4) which, through suitable electrical transmission means schematically illustrated at 138 of FIG. 5, may be applied as to related switching means 80.

Referring primarily to FIGS. 5 and 8, let it be assumed that: (a) the magnetic coil assembly means 32 is situated as to its shell 14 polarity, N, downwardly disposed thereby making the core 12 polarity, N, upwardly disposed when in a state as depicted in FIG. 1; (b) the magnet member 96 is at least generally parallel to the axis of member 10, comprising means 32, and has its polarity, N, also upwardly directed as to have its magnetic field in opposition to the polarity of shell 14; and (c) that magnet member 96 is brought close enough and has a magnetic field strength sufficient to cause switching of the bistable magnetic device 10 from its state of FIG. 1 to its state depicted in FIG. 3. It has been discovered that if a shield, such as the wall portion 110 of shutter 100, is interposed between such arranged magnet member 96 and magnetic device 10 (of magnetic coil assembly means 32) the magnetic device will not switch from its depicted state of FIG. 1 to tha of FIG. 3 even though otherwise the field strength of magnet member 96 is sufficient to cause such switching. This is believed to occur as a result of the exterior flux path of the magnet 96 becoming effectively determined by the wall 110 of shutter 100 and therefore having a less than sufficient effect on the device 10 of magnetic coil assembly means 32. It has also been discovered that the formation of aperture means, such as slots 120, 122, 124, 126, 128, 130, 132 and 134 in wall 110 of shutter 100 enables the flux field of magnet 96 to provide a sufficiently strong influencing effect upon device 10 to cause it to switch from the state of FIG. 1 to the state of FIG. 3 whenever such a slot is brought into general alignment between the magnet 96 and device 10. Accordingly, in the embodiment disclosed by FIGS. 5, 6, 7, 8 and 9, wherein it is assumed that the invention will be employed in association with an eight cylinder engine 90, there are eight of such slots or aperture means formed in the wall 110 of shutter 100, angularly equally spaced thereabout, so that in one revolution of shaft means 42 and shutter 100 a total of eight switching functions of the device 10 will occur with each such switching function including first switching the device 10 from its FIG. 1 state to its FIG.

3 state and then resetting (or switching) the device 10 back to its FIG. 1 state (the resetting of device 10 occurring as when, for example, slot 128 of FIG. 8 continues its rotation in the direction of arrow 136 and passes out of registry between magnet 96 and device 10 of magnetic coil assembly means 32). As previously discussed with referenced to FIGS. 3 and 4, when such switching of device 10 occurs, an electrical pulse is induced or generated in the coil 24 of means 32 and such pulse may be employed as, for example, a control function.

Figure 9:
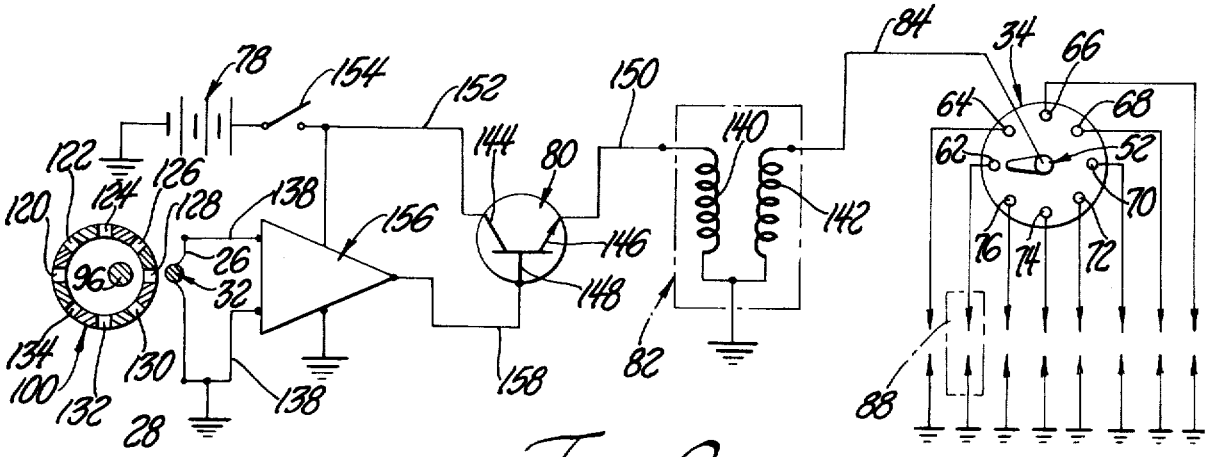
FIG. 9 is a schematic wiring diagram of an overall ignition system employing teachings of the invention.

Referring to FIG. 9, a plurality of engine ignition spark plug assemblies or igniters, functionally similar to spark plug means 88, are illustrated as being respectively electrically connected to terminals 64, 66, 68, 70, 72, 74 and 76 of ignition distributor assembly 34 and are effective to create ignition sparks as rotor 52 is sequentially brought into juxtaposition with such terminals. The ignition coil assembly 82 is illustrated as comprising a primary winding 140 and a secondary winding 142, which may be electrically connected as to a common ground, with the output terminal of winding 142 being electrically connected via conductor means 84 to the rotor means 52. The switch 80 may comprise transistor means having collector 144, emitter 146 and base 148 terminals with emitter 146 being connected, as via conductor means 150, to the input of primary winding 140 of ignition coil 82 while collector 144 is connected as by conductor means 152 and serially situated engine ignition switch 154 to the source of electrical potential 78. Suitable amplifier means 156 has its input end operatively electrically connected to electrical ends 26 and 28 of coil 24 (comprising means 32) while its output is electrically connected as by conductor means 158 to the base 148 of transistor means 80. It should be remembered that, as disclosed with reference to FIGS. 5 and 8, shaft means 42 causes rotation of both shutter means 100 and ignition rotor 52.

Still referring to FIG. 9, it can be seen that as each aperture (as typified by slot 128) comes into registry with magnet 96 and magnetic coil assembly means 32 a pulse is generated in coil leads 26, 28 and applied as to related suitable amplifier means 156 which, in turn, causes transistor 80 to terminate conduction through conductor means 152, 150 resulting in the field previously created by ignition primary coil 140 to collapse thereby inducing a high voltage in secondary winding 142 which is discharged through rotor means 52 to a juxtaposed distributor terminal (as typified by terminal 62).

In the preferred embodiment of the invention, the magnet 98 is provided as a reset magnet. Its polarity is the same as that of the shell 14 of device 10 thereby providing a field complementing that of shell 14 and enhancing the shell's magnetic field in causing the core 12 to assume a condition or state as depicted in FIG. 1. Accordingly, in such an arrangement, the reset magnet 98 tends to maintain device 10 in its FIG. 1 state until the last possible moment when an aperture or slot (as exemplified by slot 128 FIG. 8) is in a position to enable the maximum effect of the field of the triggering magnet 96 to be applied to device 10. This results in a more rapid switching providing for a better pulse generation. Obviously, the field strength of trigger magnet 96 is of a magnitude sufficient to overcome (when a shutter slot is properly positioned) the combined effective field strengths of the shell 14 and reset magnet 98. Further, in the preferred embodiment, the reset magnet 98 is situated as to be, time-wise, subsequent to both magnetic coil assembly means 32 and trigger magnet 96. That is, each shutter aperture or slot, as 128, first comes into juxtaposition with trigger magnet 98 and assembly means 32 before such slot comes into juxtaposition with reset magnet 98. Consequently, referring to FIG. 8, as shutter slot 128 moves from the position shown, and in the direction of arrow 136, the degree of influence of the magnetic field on magnetic device 10 by trigger magnet 96 continually diminishes while, at the same time, the degree of influence of the magnetic field on magnet device 10 by reset magnet 98 continually increases. This, as far as magnet device 10 is concerned, is a rapidly occurring additive effect resulting in the magnet device 10 of means 32 being rapidly reset to its FIG. 1 with an attendant rapid collapse of the magnetic field 22 of FIG. 3 producing the desired pulse signal in coil means 24 and further assuring that magnetic device 10 of means 32 is in its FIG. 1 state well in advance of the arrival of the subsequent shutter slot as 126.

Figure 11:
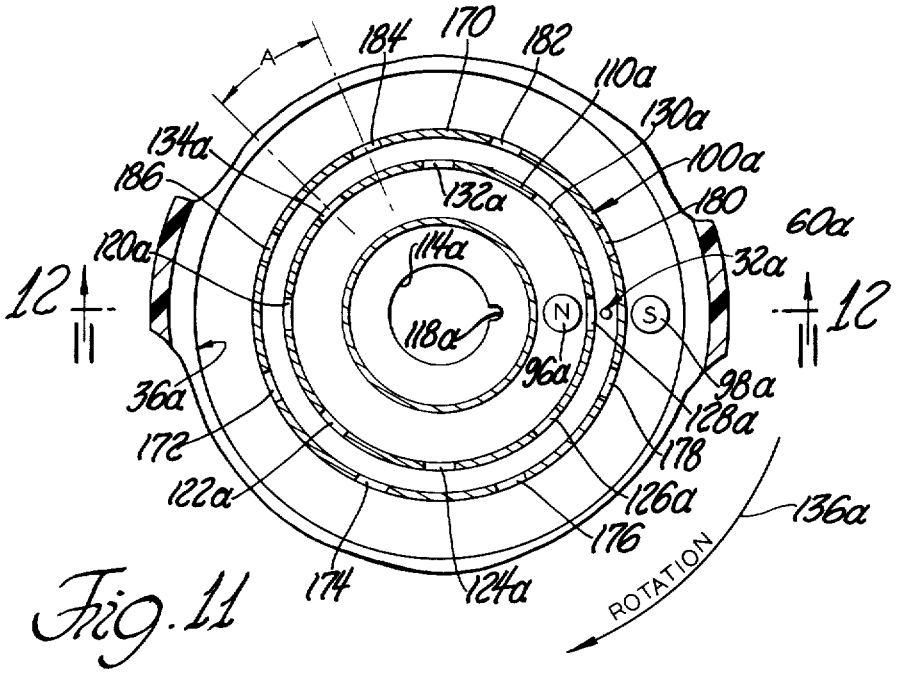
FIG. 11 is a cross-sectional view taken generally on the plane of line 11—11 of FIG. 10 and looking in the direction of the arrows with certain of the elements shown in FIG. 10 being omitted for purposes of clarity.
Figure 10:
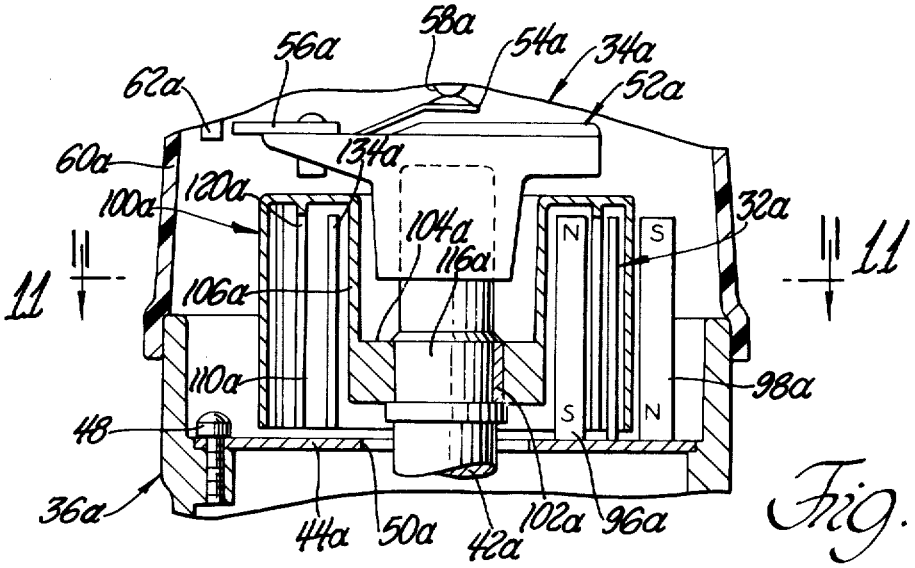
FIG. 10 is an axial cross-sectional view of a fragmentary portion of the structure of FIG. 5 but showing another embodiment of the invention.
Figure 12:
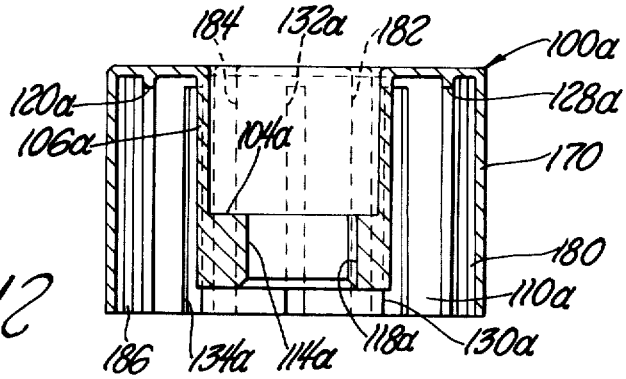
FIG. 12 is an axial cross-sectional view of one of the elements shown in FIG. 10.

FIGS. 10, 11 and 12 illustrate another embodiment of the invention. FIG. 10 may be considered as a view similar to that of FIG. 5 but showing only a fragmentary portion of the environmental structure thereof and further modified in accordance with the teachings of this second embodiment of the invention. All elements in FIGS. 10, 11 and 12 which are like or similar to those of, for example, FIGS. 4–8, are identified with like reference numbers provided with a suffix "a".

Referring in greater detail to FIGS. 10, 11 and 12, it can be seen that wall **110*a* is functionally equivalent to wall 110 of FIGS. 6, 7 and 8 in that it passes between magnet 96*a* and magnetic coil assembly means 32*a*. Further, wall 110*a* is provided with similar equidistantly spaced slots 120*a*, 122*a*, 124*a*, 126*a*, 128*a*, 130*a*, 132*a* and 134*a*. Shutter means 100*a* is also provided with a second cylindrical wall 170 which passes generally between the reset magnet 98*a* and magnetic coil assembly means 32*a*. Such wall 170 is likewise provided with generally longitudinally directed angularly equally spaced slots 172, 174, 176, 178, 180, 182, 184 and 186. Preferably, and as best shown in FIG. 11, the slots or apertures in outermost wall 170 are angularly displaced by 22.5° with respect to the slots or aperture means of the cylindrical wall 110*a* as generally typically depicted by angle A in FIG. 11**. It should, of course, be apparent that the degree to which the respective two sets of slots or aperture means are thusly angularly spaced from each other is not limited to the magnitude of 22.5° and such displacement, if any, may be of any suitable magnitude desired consistent with the particular use thereof.

Further, in the preferred embodiment of the modification of FIGS. 10, 11 and 12, the triggering magnet **96*a*, the magnetic coil assembly means 32*a* and the reset magnet 98*a* are preferably positioned to have their respective longitudinal axes contained, substantially, in a common plane which also, generally, passes through the axis of rotation of shutter means 100*a***.

The operation of the invention as depicted by FIGS. 10, 11 and 12 is like that of the invention described with reference to FIGS. 1–9. In the main, the principal difference is that after the magnetic coil assembly means **32*a* is placed into a first of its states by being under the influence of trigger magnet 96*a* as when slot or aperture means 128*a* is in the position depicted, the reset magnet 98*a* is prevented from exhibiting any appreciable magnetic influence upon magnetic coil assembly means 32 until shutter means 100*a* has rotated sufficiently as to bring slot or aperture means 180 generally between reset magnet means 98***a* and magnetic coil assembly means 32*a* at which time the reset magnet 98*a* causes the magnetic coil assembly means 32*a* to be switched to its other FIG. 1 state with an attendant rapid collapse of the magnetic field 22 of FIG. 3 producing the desired electrical pulse signal as in coil means 24 and further assuring that magnetic device 10 of means 32 is in its FIG. 1 state well in advance of the arrival of the subsequent shutter slot 130*a*.

As should be noted, in the embodiment of FIGS. 10, 11 and 12, during the time in which maximum magnetic effect on magnetic device 10 by trigger magnet 96*a* is desired, such magnetic device 10 is effectively shielded by wall 170 from the influence of reset manget means 98*a*, and, when a maximum magnetic effect on magnetic device 10 by reset magnet 98*a* is desired, such magnetic device 10 is effectively shielded by wall 110*a* from the influence of trigger magnet 96*a*. Accordingly, a more precise and repeatable switching function is made possible if such is, in fact, desired.

Figure 13:
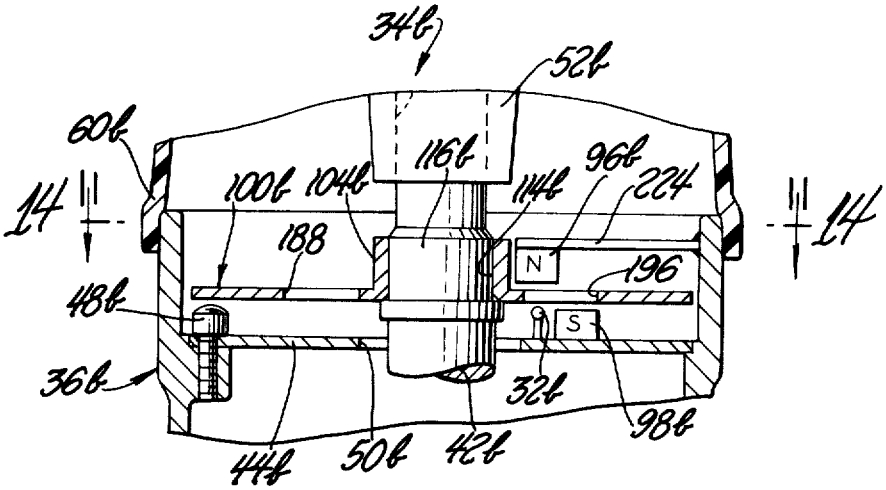
FIG. 13 is a view similar to that of FIG. 10 but showing still another embodiment of the invention.
Figure 14:
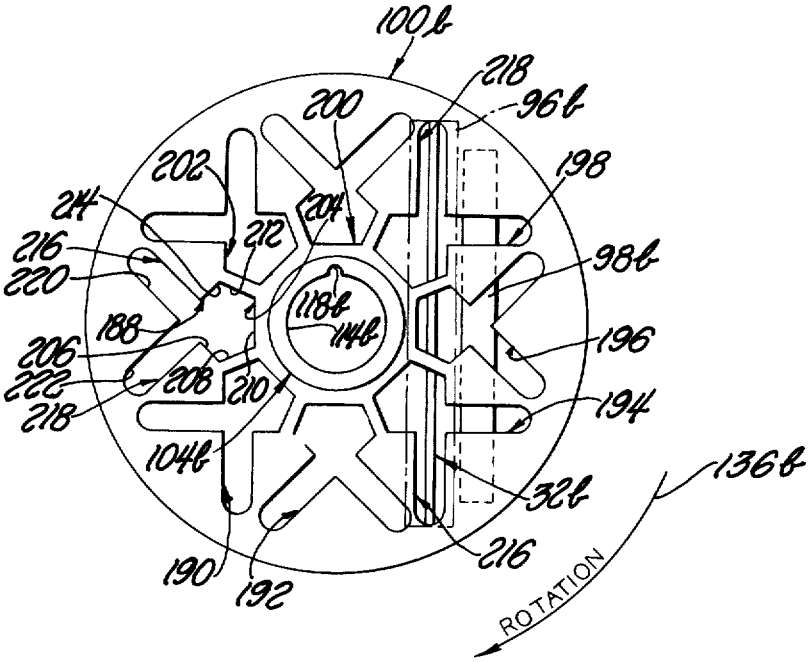
FIG. 14 is a view taken generally on the plane of line 14—14 of FIG. 13 and looking in the direction of the arrows with certain elements shown in FIG. 13 being omitted for purposes of clarity.

FIGS. 13 and 14 illustrate another embodiment of the invention. FIG. 13 may be considered as a view similar to that of either FIGS. 5 or 10 but showing only a fragmentary portion of the environmental structure shown in FIG. 5 and further modified in accordance with the teachings of this third embodiment of the invention. All elements in FIGS. 13 and 14 which are like or similar to those of, for example, FIGS. 4–8, are identified with like reference numbers provided with a suffix "b".

Referring in greater detail to FIGS. 13 and 14, it can be seen that the shutter means 100*b* takes the form of a generally laterally extending disc-like plate which, in turn, is provided with a plurality of slot-like openings or aperture means 188, 190, 192, 194, 196, 198, 200 and 202.

As will become apparent, each of such aperture means 188–202 are multi-functional. That is, referring to aperture means 188 as a typical configuration, each of the aperture means has a first or primary opening portion 204 which, in the configuration depicted, may approach a pentagonal shape when viewed as in FIG. 14. Generally, such opening or portion 204 may be considered as being defined by edges or sides 206, 208, 210, 212 and 214 and, if sides 206 and 214 were extended to intersect, the pentagonal configuration would be completed. Further, each of the aperture means, as also typically illustrated by aperture means 188, comprises a pair of generally elongated slot-like extensions 216 and 218 which, at their radially innermost ends join with opening portions 204 generally in that area where otherwise sides 206 and 214, if extended, would intersect. In the preferred embodiment of the modification of the invention of FIGS. 13 and 14, side or edge 220 of slot extension 216 is in line with (as an extension of) side or edge 206 while side or edge 222 of slot extension 218 is in line with (as an extension of) side or edge 214. Further, in the particular embodiment depicted, the slot extensions 216 and 218 are at generally 45° with respect as to a centerline passing through the axis of rotation and the middle of the respective aperture means. Also, when alternate ones of such aperture means are compared, it will be noted that the edge 222 of the slot extension 218 of one such aperture means is in general alignment with the edge 220 of the slot extension or slot arm 216 of the next alternate aperture means.

As shown in both FIGS. 13 and 14, the magnetic coil assembly means 32*b* is situated generally horizontally (generally parallel to shutter means 100*b*) and supported by related suitable support means carried as by plate 44*b*. Similarly, the reset magnet 98*b* is also generally parallel and also fixedly supported as by plate 44*b*. The trigger magnet 96*b*, is also parallel to magnetic coil assembly means 32*b* and thusly supported as by related support bracket means 224 in order to be positioned on the opposite side of shutter means 100*b*.

As will be obvious, especially in view of the following, the operational concept of the invention of FIGS. 13 and 14 is as that of FIGS. 5–8.

When the shutter means or disc 100*b* attains the position depicted in FIG. 14, maximum exposure of the magnetic coil assembly means 32*b* to the triggering magnet 96*b* is attained because of slot arm or extension 218 of aperture means 198 and slot arm or extension 216 of aperture means 194 being aligned with both the magnetic coil assembly means 32*b* and the triggering magnet 96*b*. Accordingly, a resulting maximum magnetic influence by magnet 96*b* is imposed upon the magnetic device 10 of means 32*b* sufficient as to overcome the opposite influence of magnet 98*b* and to cause the magnetic device 10 to be switched to its FIG. 3 state or condition.

As shutter means 100*b* rotates in the direction of arrow 136*b*, arm-like slots 218 and 216 of aperture means 198 and 194, respectively, start to become rotated out of such registry with means 32*b* and trigger magnet 96*b* thereby reducing the magnetic influence which trigger magnet 96*b* can exert on the magnetic device 10 of means 32*b*. In the specific embodiment illustrated, as such additional rotation of shutter means approaches 22.5° the magnetic influence produced by trigger magnet 96*b* becomes insufficient to overcome the opposite magnetic influence produced by reset magnet 98*b* thereby enabling the reset magnet 98*b* to again switch device 10 of means 32*b* back to its FIG. 1 state thereby causing a rapid collapse of the magnetic field 22 and producing an electrical output pulse (as previously described) while, at the same time assuring that the device 10 will be in its proper state in anticipation of the next following triggering function when slot arms 216 and 218 of aperture means 196 and 200, respectively, rotate into registry between trigger magnet 96*b* and magnetic device 10 of means 32*b*.

Figure 15:
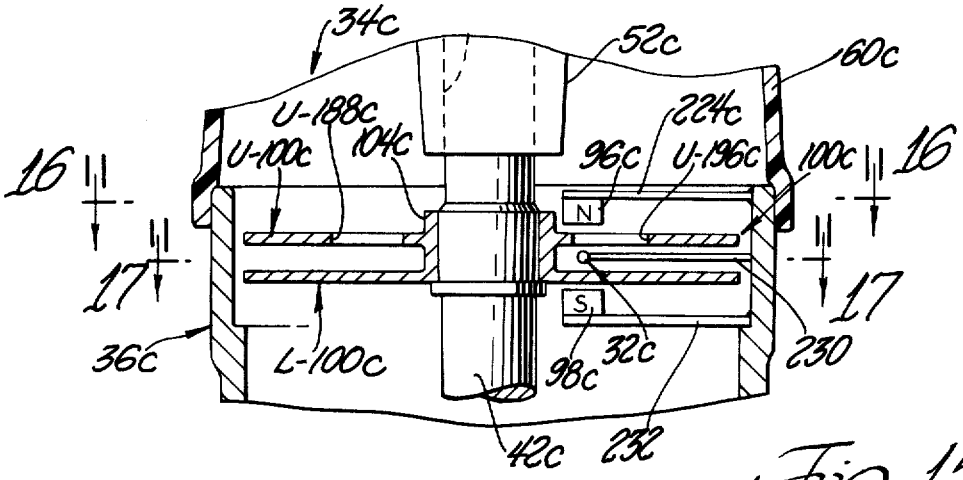
FIG. 15 is a view similar to that of FIG. 13 but illustrating yet another embodiment of the invention.
Figure 16:
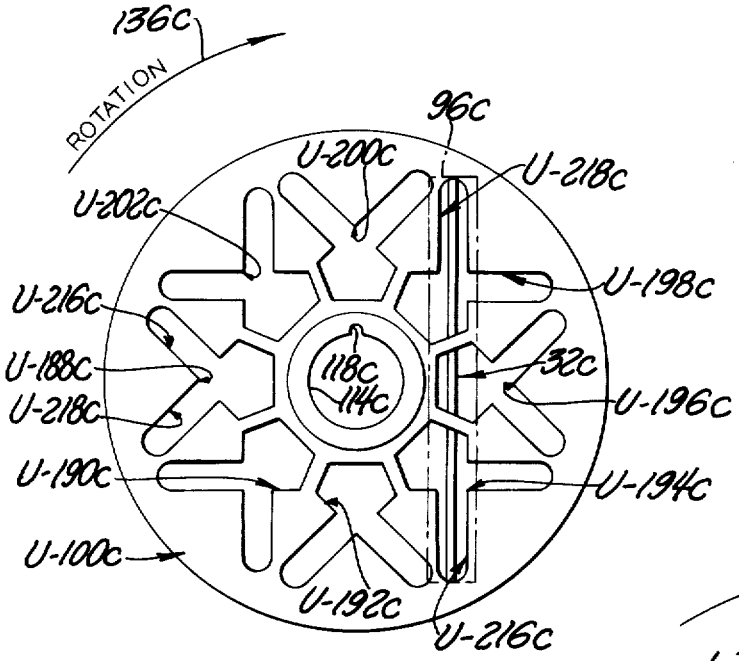
FIG. 16 is a view taken generally on the plane of line 16—16 of FIG. 15 and looking in the direction of the arrows with certain elements shown in FIG. 15 being omitted for purposes of clarity.
Figure 17:
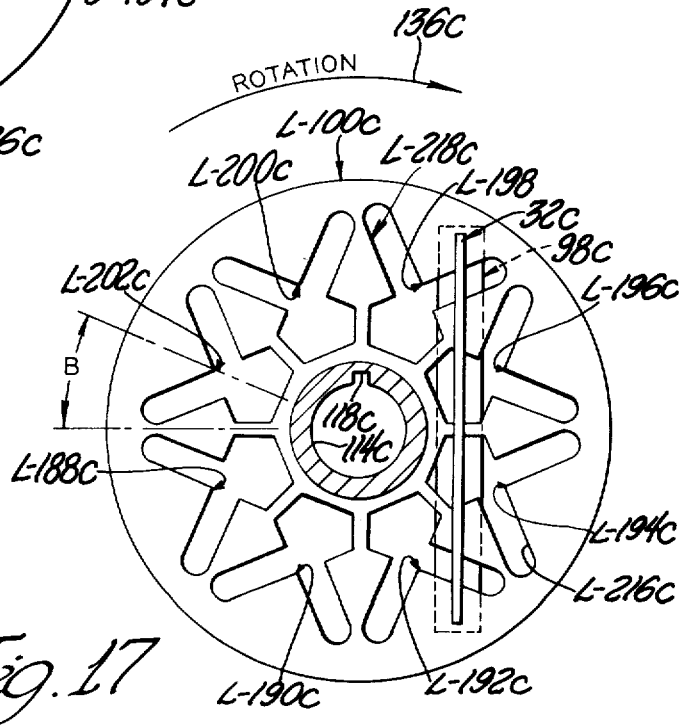
FIG. 17 is a view taken generally on the plane of line 17—17 of FIG. 15 and looking in the direction of the arrows with certain elements shown in FIG. 15 being omitted for purposes of clarity.

FIGS. 15, 16 and 17 illustrate another embodiment of the invention. FIG. 15 may be considered as a view similar to that of either FIGS. 5, 10 or 13 but showing only a fragmentary portion of the environmental structure shown in FIG. 5 and further modified in accordance with the teachings of this fourth embodiment of the invention. All elements in FIGS. 15, 16 and 17 which are like or similar to those of the preceding Figures, except as otherwise specifically noted, are identified with like reference numbers provided with a suffix "c". The exception referred to relates to the shutter means 100*c*. As will be noted in FIG. 15 and in FIGS. 16 and 17, the shutter means 110*c* may be considered as actually having relatively upper and lower shutter means. Accordingly, to the extent of readily identifying and yet distinguishing similar or comparable elements of such respective upper and lower shutter means, the prefix "U" will be used in conjunction with the reference numbers relating to such of the elements of the upper shutter means as are generally duplicated in the lower shutter means wherein the prefix "L" will be used in conjunction with those reference numbers.

Referring to FIG. 15, it can be seen that the magnetic coil assembly means 32*c* is now situated generally between disc shutter portions U-100*c* and L-100*c* and supported therein as by suitable support means 230 as to be generally parallel to the planes of U-100c and L-100c. Further, reset magnet 98c is also similarly supported as by suitable support means 232 as to thereby position it also generally parallel to magnetic coil assembly means 32c but on the opposite side of disc shutter portion L-100c.

As previously explained with reference to FIGS. 13 and 14, the aperture means 188c-202c, both upper and lower, are multi-functional. The general difference, as will be completely apparent, is that the aperture means U-188c-U-202c are primarily related to the functioning of trigger magnet 96c while the aperture means L-188c-L-202c are primarily related to the functioning of reset magnet means 98c.

If not already, then as will be obvious, especially in view of the following, the operational concept of the invention of FIGS. 15, 16 and 17 is that of FIGS. 10, 11 and 12. That is, referring to FIGS. 16 and 17, when shutter disc portion U-100c attains the position depicted in FIG. 16, maximum exposure of the magnetic coil assembly means 32c (and the magnetic device 10 comprising a part thereof) to the triggering magnet 96c is attained because of slot arm or extension U-218c of aperture means U-198c and slot arm or extension U-216c of aperture means U-194c being aligned with both the magnetic coil assembly means 32c and the triggering magnet means 96c. Accordingly, a resulting maximum magnetic influence by magnet 96c is imposed upon the magnetic device 10 of means 32c sufficient to overcome whatever opposite influence may be exhibited to reset magnet 98c and thereby cause the magnetic device 10 to be switched to its FIG. 3 state or condition.

In comparing FIGS. 16 and 17, when shutter portion U-100c is in its FIG. 16 position, shutter L-100c is in the position depicted in FIG. 17. In the particular embodiment disclosed, all of the angularly equally spaced aperture means L-188c-L-202c are angularly disposed with respect to the aperture means U-188c-U-202c as by 22.5° depicted generally by angle B of FIG. 17. Accordingly, when device 10 of means 32c is under maximum influence of trigger magnet 96c because of the position of shutter portion U-100c depicted in FIG. 16, such device 10 is also under the minimum influence of reset magnet 98c because of the then corresponding position of shutter portion L-100c depicted in FIG. 17. The reason that minimal influence of reset magnet 98c is experienced at this time is because slot or arm extensions L-218c and L-216c of aperture means L-198c, L-196c, L-194c and L-192c are all out of aligned registry with device 10 of magnetic coil means 32c (as compared to the aligned registry depicted in FIG. 16 as between slot or arm extensions of the aperture means and the means 32c and trigger magnet 96c).

As the shutter means 100c is further rotated in the direction of arrows 136c, slot or arm extensions U-218c and U-216c of aperture means U-198c and U-194c, respectively, start to pass out of such registry while slot or arm extensions L-218c and L-216c of aperture means L-198c and L-194c, respectively approach registry with device 10 of means 32c and reset magnet 98c. When such registry is complete, or near complete, device 10 is placed under the greatest influence of reset magnet 98c while, at the same time, being under the least influence of trigger magnet 96c. The thusly reduced influence by trigger magnet 96c becomes insufficient to overcome the opposite magnetic influence produced by reset magnet 98c thereby enabling the reset magnet 98c to again switch device 10 of means 32c back to its FIG. 1 state thereby causing a rapid collapse of the magnetic field 22 and producing an electrical pulse (as previously described) while, at the same time, assuring that the device 10 will be in its proper state in anticipation of the next following triggering function when slot arms or extensions U-216c and U-218c of aperture means U-196c and U-200c, repectively, rotate into registry between trigger magnet 96c and magnetic device 10 of means 32c to repeat the process.

The shutter means 100c has been illustrated as being a unitary device having integrally formed upper and lower shutter portions U-100c and L-100c; it should be apparent that such could be comprised of structurally separate components which could, in turn, be assembled in the desired relative relationship to achieve the desired function for the particular operational environment. Further, it should be apparent that the aperture means U-188c through U-202c need not correspond in size or configuration to the aperture means L-188c through L-202c.

The invention as herein disclosed has been described with reference to an engine ignition distributor assembly. However, the inventive concepts are obviously not so limited in that the essence of the invention and disclosure apply equally well to any related environment wherein signal pulse generation is desired regardless of whether such pulse generation is in relation to what may be termed a timed operational relationship or in response to a sensed randomly occurring event.

It should also be apparent that should it be desired to provide ignition advance means in those embodiments of the invention employed as, for example, ignition distributor assemblies, such may be accomplished as by providing appropriate means responsive to indicia of engine operation (such as, for example, engine vacuum and/or engine speed) for causing relative angular movement of the shutter means relative to and about its axis of rotation, and/or causing simultaneous angular movement of the device 10 (means 32) and influencing external magnet means relative to and about such axis of rotation. Generally, such means for affecting ignition advance and retard are well-known in the art and need not herein be disclosed in detail especially since the practice of the invention is not dependent thereon.

Further, the coil means 24 of FIG. 4 has been illustrated as being a single winding; obviously, if desired, such coil means 24 may actually comprise a plurality of coils such as are sometimes referred to as, double-wound, or the like.

Although only a preferred embodiment and selected modifications of the invention have been disclosed and described, it is apparent that other embodiments and modifications of the invention are possible within the scope of the appended claims.

I claim:

1. A pulse generator, comprising an axially extending magnetic wire, said magnetic wire having a medially disposed axially extending central portion of relatively low magnetic retentivity and coercivity and an axially extending outer shell of relatively high magnetic retentivity and coercivity, said shell having a magnetic field adapted for magnetizing said central portion in a first generally axial direction such that the magnetization of the central portion is reversible by application of a second magnetic field having an effective magnitude of at least a predetermined magnitude, said magnetic field of said shell also being operable to remagnetize said central portion in said first direction upon reduction of the effective magnitude of said second magnetic field below said predetermined magnitude, inductive coil means about said magnetic wire as to extend generally axially therealong and having at least first and second ends for electrical connection to associated electrical pulse signal receiving output means, first magnet means situated in relatively close proximity to and spaced from said magnetic wire and said inductive coil means, said first magnet means and said magnetic wire and inductive coil means being fixedly positioned relative to each other, said first magnet means being effective for creating said second magnetic field, relatively movable shutter means situated generally between said first magnet means and said magnetic wire and inductive coil means, said shutter means comprising aperture means, said aperture means when presented by said shutter means as to be generally between said first magnet means and said magnetic wire and inductive coil means permitting said second magnetic field to pass therethrough and be applied to said magnetic wire as to magnetize said central portion in a second direction opposite to said first direction thereby creating a resulting external magnetic field about said magnetic wire, said shutter means upon removing said aperture means from registry with said magnet means and said magnetic wire and inductive coil means being effective to reduce the effective magnitude of said second magnetic field as is applied to said magnetic wire to a magnitude less than said predetermined magnitude thereby permitting said central portion to be remagnetized in said first direction and thereby causing said resulting external magnetic field to collapse, said inductive coil means being responsive to at least the said collapse of said resulting external magnetic field for creating said electrical pulse signal as electrically across said first and second ends, and second magnet means situated in relatively close proximity to and spaced from said magnetic wire and said inductive coil means, said second magnet means and said magnetic wire means being situated at a first side of said shutter means and said first magnet means being situated at a second side of said shutter means opposite to said first side, said second magnetic means producing a third magnetic field effective for influencing said magnetic wire and tending to cause said central portion of said magnetic wire to remagnetize in said first direction.

2. A pulse generator according to claim 1 wherein said shutter means comprises a rotatable shutter member, wherein said rotatable shutter member comprises a generally annular wall, and wherein said aperture means comprises a plurality of apertures formed in said annular wall and angularly spaced from each other.

3. A pulse generator according to claim 2 wherein at least said second magnet means and said magnetic wire have longitudinal axes generally parallel to the axis of rotation of said rotatable shutter member.

4. A pulse generator according to claim 2 wherein said first magnet means and said magnetic wire have longitudinal axes generally parallel to each other and skew with respect to the axis of rotation of said rotatable shutter member.

5. A pulse generator according to claim 2 wherein said first magnet means and said magnetic wire have longitudinal axes respectively contained in planes which can be either parallel or transverse to the axis of rotation of said rotatable shutter member but not otherwise fully containing said axis of rotation of said rotatable shutter member.

6. A pulse generator, comprising an axially extending magnetic wire, said magnetic wire having a medially disposed axially extending central portion of relatively low magnetic retentivity and coercivity and an axially extending outer shell of relatively high magnetic retentivity and coercivity, said shell having a magnetic field adapted for magnetizing said central portion in a first generally axial direction such that the magnetization of the central portion is reversible by application of a second magnetic field having an effective magnitude of at least a predetermined magnitude, said magnetic field of said shell also being operable to remagnetize said central portion in said first direction upon reduction of the effective magnitude of said second magnetic field below said predetermined magnitude, inductive coil means about said magnetic wire as to extend generally axially therealong and having at least first and second ends for electrical connection to associated electrical pulse signal receiving output means, first magnet means situated in relatively close proximity to and spaced from said magnetic wire and said inductive coil means, said first magnet means and said magnetic wire and inductive coil means being fixedly positioned relative to each other, said first magnet means being effective for creating said second magnetic field, and relatively movable shutter means situated generally between said first magnet means and said magnetic wire and inductive coil means, said shutter means comprising aperture means, said aperture means when presented by said shutter means as to be generally between said first magnet means and said magnetic wire and inductive coil means permitting said second magnetic field to pass therethrough and be applied to said magnetic wire as to magnetize said central portion in a second direction opposite to said first direction thereby creating a resulting external magnetic field about said magnetic wire, said shutter means upon removing said aperture means from registry with said magnet means and said magnetic wire and inductive coil means being effective to reduce the effective magnitude of said second magnetic field as is applied to said magnetic wire to a magnitude less than said predetermined magnitude thereby permitting said central portion to be remagnetized in said first direction and thereby causing said resulting external magnetic field to collapse, said inductive coil means being responsive to at least the said collapse of said resulting external magnetic field for creating said electrical pulse signal as electrically across said first and second ends, and second magnet means situated in relatively close proximity to and spaced from said magnetic wire and said inductive coil means, said shutter means comprising a first annular wall portion and a second annular wall portion, said first and second annular wall portions being spaced from each other, said first annular wall portion passing between said first magnet means and said magnetic wire and inductive coil means as to have said first magnet means at one side of said first annular wall portion and said magnetic wire and inductive coil means at an other side of said first annular wall portion opposite to said one side, said second annular wall portion passing between said second magnet means and said magnetic wire and inductive coil means as to have said second magnet means at a first side of said second annular wall portion and said magnetic wire and inductive coil means at an other side of said second annular wall portion opposite to said first side, said aperture means comprising first aperture means formed in said first annular wall portion and second aperture means formed in said second annular wall portion, said first aperture means being effective to be at times presented by said shutter means in general registry with and between said first magnet means and said magnetic wire, and said second aperture means being effective to be at times presented by said shutter means in general registry with and between said second magnet means and said magnetic wire, said second magnet means producing a third magnetic field effective when said second aperture means is in said general registry with said second magnet means and said magnetic wire for influencing said magnetic wire and tending to cause said central portion of said magnetic wire to remagnetize in said first direction.

7. A pulse generator, comprising a magnetic wire, said magnetic wire having a central portion of relatively low magnetic retentivity and coercivity and an outer shell of relatively high magnetic retentivity and coercivity, said shell having a magnetic field adapted for magnetizing said central portion in a first generally axial direction such that the magnetization of the central portion is reversible by application of a second magnetic field having an effective magnitude of at least a predetermined magnitude, said magnetic field of said shell also being operable to remagnetize said central portion in said first direction upon reduction of the effective magnitude of said second magnetic field below said predetermined magnitude, inductive coil means carried generally about said magnetic wire and having at least first and second ends for electrical connection to associated electrical pulse signal receiving output means, magnet means situated in relatively close proximity to and spaced from said magnetic wire and said inductive coil means, said magnet means and said magnetic wire and inductive coil means being fixedly positioned relative to each other, said magnet means being effective for creating said second magnetic field, relatively movable shutter means situated generally between said magnet means and said magnetic wire and inductive coil means, said shutter means comprising aperture means, said aperture means when presented by said shutter means as to be generally between said magnet means and said magnetic wire and inductive coil means permitting said second magnetic field to pass therethrough and be applied to said magnetic wire as to magnetize said central portion in a second direction opposite to said first direction thereby creating a resulting external magnetic field about said magnetic wire, said shutter means upon removing said aperture means from registry with said magnet means and said magnetic wire and inductive coil means being effective to reduce the effective magnitude of said second magnetic field as is applied to said magnetic wire to a magnitude less than said predetermined magnitude thereby permitting said central portion to be remagnetized in said first direction and thereby causing said resulting external magnetic field to collapse, said inductive coil means being responsive to at least the said collapse of said resulting external magnetic field for creating said electrical pulse signal as electrically across said first and second ends, and second magnet means situated in relatively close proximity to and spaced from said magnetic wire and said inductive coil means, said second magnet means producing a third magnetic field effective for influencing said magnetic wire and tending to cause said central portion of said magnetic wire to remagnetize in said first direction, said shutter means being also situated generally between said second magnet means and said magnetic wire and inductive coil means, said aperture means comprising first aperture means and second aperture means, said first aperture means being effective to be at times presented by said shutter means in general registry with and between said first mentioned magnet means and said magnetic wire, said second aperture means being effective to be at times presented by said shutter means in general registry with and between said second magnet means and said magnetic wire, said shutter means comprising a rotatable first generally annular wall and a rotatable second generally annular wall, said first aperture means comprising a plurality of first apertures formed in said first annular wall and angularly spaced from each other, and said second aperture means comprising a plurality of second apertures formed in said second annular wall and angularly spaced from each other.

8. A pulse generator according to claim 7 wherein said first and second generally annular walls are rotatable about a common axis of rotation.

9. A pulse generator according to claim 7 wherein said first and second generally annular walls are rotatable in timed relationship.

10. A pulse generator according to claim 7 wherein said first and second generally annular walls are rotatable in unison with each other.

11. A pulse generator, comprising a magnetic wire, said magnetic wire having a central portion of relatively low magnetic retentivity and coercivity and an outer shell of relatively high magnetic retentivity and coercivity, said shell having a magnetic field adapted for magnetizing said central portion in a first generally axial direction such that the magnetization of the central portion is reversible by application of a second magnetic field having an effective magnitude of at least a predetermined magnitude, said magnetic field of said shell also being operable to remagnetize said central portion in said first direction upon reduction of the effective magnitude of said second magnetic field below said predetermined magnitude, inductive coil means carried generally about said magnetic wire and having at least first and second ends for electrical connection to associated electrical pulse signal receiving output means, magnet means situated in relatively close proximity to and spaced from said magnetic wire and said inductive coil means, said magnet means and said magnetic wire and inductive coil means being fixedly positioned relative to each other, said magnet means being effective for creating said second magnetic field, relatively movable shutter means situated generally between said magnetic means and said magnetic wire and inductive coil means, said shutter means comprising aperture means, said aperture means when presented by said shutter means as to be generally between said magnet means and said magnetic wire and inductive coil means permitting said second magnetic field to pass therethrough and be applied to said magnetic wire as to magnetize said central portion in a second direction opposite to said first direction thereby creating a resulting external magnetic field about said magnetic wire, said shutter means upon removing said aperture means from registry with said magnet means and said magnetic wire and inductive coil means being effective to reduce the effective magnitude of said second magnetic field as is applied to said magnetic wire to a magnitude less than said predetermined magnitude thereby permitting said central portion to be remagnetized in said first direction and thereby causing said resulting external magnetic field to collapse, said inductive coil means being responsive to at least the said collapse of said resulting external magnetic field for creating said electrical pulse signal as electrically across said first and second ends, and second magnet means situated in relatively close proximity to and spaced from said magnetic wire and said inductive coil means, said second magnet means producing a third magnetic field effective for influencing said magnetic wire and tending to cause said central portion of said magnetic wire to remagnetize in said first direction, said shutter means being also situated generally between said second magnet means and said magnetic wire and inductive coil means, said aperture means comprising first aperture means and second aperture means, said first aperture means being effective to be at times presented by said shutter means in general registry with and between said first mentioned magnet means and said magnetic wire, said second aperture means being effective to be at times presented by said shutter means in general registry with and between said second magnet means and said magnetic wire, said shutter means comprising a rotatable cup-like member said cup-like member having a first generally annular wall and a second generally annular wall, said first aperture means comprising a plurality of first apertures formed in said first annular wall and angularly spaced from each other, and said second aperture means comprising a plurality of second apertures formed in said second annular wall and angularly spaced from each other.

12. A pulse generator according to claim 11 wherein said first annular wall is of a first inner diameter and a first outer diameter, wherein said second annular is of a second inner diameter and a second outer diameter, and wherein said second inner diameter is of a magnitude substantially greater than the magnitude of said first outer diameter.

13. A pulse generator according to claim 11 wherein said plurality of first apertures comprises a plurality of slot openings respectively having longitudinal axes generally parallel to the axis of rotation of said cup-like member.

14. A pulse generator according to claim 11 wherein said plurality of second apertures comprises a plurality of slot openings respectively having longitudinal axes generally parallel to the axis of rotation of said cup-like member.

15. A pulse generator according to claim 11 wherein said plurality of first apertures are formed in said first annular wall and said plurality of second apertures are formed in said second annular wall in a manner as to have each of said second apertures angularly displaced with respect to said first apertures.

16. A pulse generator according to claim 2 wherein said annular wall comprises disc-like member radiating generally in a plane generally normal to the axis of rotation of said rotatable shutter member.

17. A pulse generator according to claim 16 wherein at least said first magnet means and said magnetic wire have longitudinal axes generally parallel to each other and generally parallel to said disc-like member.

18. A pulse generator according to claim 17 wherein each of said plurality of apertures as each are rotated through a predetermined zone of rotation is first effective to only partially expose said magnetic wire to the influence of said second magnetic field and subsequently expose said magnetic wire to a maximum degree to the influence of said second magnetic field.

19. A pulse generator, comprising a magnetic wire, said magnetic wire having a central portion of relatively low magnetic retentivity and coercivity and an outer shell of relatively high magnetic retentivity and coercivity, said shell having a magnetic field adapted for magnetizing said central portion in a first generally axial direction such that the magnetization of the central portion is reversible by application of a second magnetic field having an effective magnitude of at least a predetermined magnitude, said magnetic field of said shell also being operable to remagnetize said central portion in said first direction upon reduction of the effective magnitude of said second magnetic field below said predetermined magnitude, inductive coil means about said magnetic wire and having at least first and second ends for electrical connection to related electrical pulse signal receiving output means, magnet means situated in relatively close proximity to and spaced from said magnetic wire and said inductive coil means, said magnet means and said magnetic wire and inductive coil means being fixedly positioned relative to each other, said magnet means being effective for creating said second magnetic field, and relatively movable shutter means situated generally between said magnet means and said magnetic wire and inductive coil means, said shutter means comprising aperture means, said aperture means when presented by said shutter means as to be generally between said magnet means and said magnetic wire and inductive coil means permitting said second magnetic field to pass therethrough and be applied to said magnetic wire as to magnetize said central portion in a second direction opposite to said first direction thereby creating a resulting external magnetic field about said magnetic wire, said shutter means upon removing said aperture means from registry with said magnet means and said magnetic wire and inductive coil means being effective to reduce the effective magnitude of said second magnetic field as is applied to said magnetic wire to a magnitude less than said predetermined magnitude thereby permitting said central portion to be remagnetized in said first direction and thereby causing said resulting external magnetic field to collapse, said inductive coil means being responsive to at least the said collapse of said resulting external magnetic field for creating said electrical pulse signal as electrically across said first and second ends, said shutter means comprising a rotatable shutter, said rotatable shutter comprising first and second annular walls, said first annular wall comprising a first disc-like member radiating generally in a plane generally normal to the axis of rotation of said rotatable shutter, said second annular wall comprising a second disc-like member radiating generally in a second plane generally normal to the axis of rotation of said rotatable shutter and generally parallel to said first disc-like member, and said aperture means comprising a plurality of first apertures formed in said first disc-like member and angularly spaced thereabout and a plurality of second apertures formed in said second disc-like member and angularly spaced thereabout.

20. A pulse generator according to claim 19 wherein said magnetic wire is situated generally between said first and second disc-like members, wherein said magnet means is situated at the opposite side of one of said disc-like members, and wherein said magnetic wire and magnet means are so positioned as to be generally parallel to each other and to said one of said disc-like members.

21. A pulse generator according to claim 20 and further comprising second magnet means situated in relatively close proximity to said magnetic wire and at the opposite side of the other of said disc-like members, said second magnet means producing a third magnetic field effective for influencing said magnetic wire and tending to cause said central portion of said magnetic wire to remagnetize in said first direction.

22. A pulse generator according to claim 21 wherein said second magnet means is positioned as to be generally parallel to said magnetic wire.

23. A pulse generator according to claim 21 wherein said plurality of first apertures are formed in said first disc-like member and said plurality of second apertures are formed in said second disc-like member in a manner as to have each of said second apertures angularly displaced with respect to said first apertures.

24. A pulse generator according to claim 1 and further comprising rotatable shaft means, rotatable electrical discharge terminal means carried by said rotatable shaft means for rotation in unison therewith, a plurality of angularly spaced electrical terminals adapted to be sequentially placed in juxtaposition with said rotatable electrical discharge terminal means as said rotatable electrical discharge terminal means is rotated by said rotatable shaft means, wherein said shutter means is operatively carried by said rotatable shaft means for rotation in unison therewith, and wherein said electrical pulse receiving output means comprises combustion engine ignition system means, said ignition system means comprising ignition coil means electrically connected to said rotatable electrical discharge terminal means and electrically connected to an electrical switching means which is in turn electrically connected to related source of electrical potential and electrical amplification means, and wherein said first and second ends are electrically connected to said electrical amplification means for at times closing said electrical switching means.

25. A pulse generator according to claim 2 wherein at least said first magnet means and said magnetic wire have longitudinal axes generally parallel to the axis of rotation of said rotatable shutter member.

26. A pulse generator according to claim 2 wherein second magnet means and said magnetic wire have longitudinal axes generally parallel to each other and skew with respect to the axis of rotation of said rotatable shutter member.

* * * * *